United States Patent [19]

Callegari

[11] Patent Number: 4,787,155

[45] Date of Patent: Nov. 29, 1988

[54] TOE FOR LONG-DISTANCE SKIING BOOTS

[75] Inventor: Mario Callegari, Biadene Di Montebelluna, Italy

[73] Assignee: Icaro Olivieri & C. SpA, Italy

[21] Appl. No.: 63,973

[22] Filed: Jun. 19, 1987

[30] Foreign Application Priority Data

Jun. 20, 1986 [IT] Italy ..... 83374 A/86

[51] Int. Cl.[4] ..... A43B 5/04; A63C 9/00

[52] U.S. Cl. ..... 36/117; 280/615

[58] Field of Search ..... 36/117-121, 36/132; 280/611, 613, 614, 615, 617, 623

[56] References Cited

U.S. PATENT DOCUMENTS 3,992,789 11/1976 Dikoff ..... 36/117
4,235,452 11/1980 Linecker ..... 280/615
4,363,498 12/1982 Biermann et al. ..... 36/117 X
4,531,309 7/1985 Vandenberg et al. ..... 36/117
4,691,936 9/1987 Nowak et al. ..... 280/615

FOREIGN PATENT DOCUMENTS 0169429 1/1986 European Pat. Off. ..... 36/117
3015052 11/1980 Fed. Rep. of Germany .
2306721 11/1976 France .
2443814 7/1980 France .

*Primary Examiner*—James Kee Chi
*Attorney, Agent, or Firm*—Wegner & Bretschneider

[57] ABSTRACT

Toe for long-distance skiing boots (10) of which the sole is conformed as required, a recess (23) to accommodate an elongate replaceable element (22) being comprised in the front lower portion of the boot (10).

6 Claims, 1 Drawing Sheet

TOE FOR LONG-DISTANCE SKIING BOOTS

This invention concerns a toe for long-distance skiing boots; to be more exact, the invention concerns a toe for long-distance skiing boots which is suitable for employment either with a normal step or with the so-called skater's step.

The normal step and the skater's step are known in the skiing art.

It is known that with the normal step it is necessary for the lengthwise oscillation of the foot to take place with the point of rotation as far forwards as possible.

It is also known that with the skater's step the oscillation of the foot should take place as far backwards as possible so as to obtain the greatest efficiency of the boot/attachment/ski assembly.

It is further known that, while boots of a type used for competitions may be conformed from the very beginning for a specific type of step, boots of a general sports type should be structured in the most flexible manner possible so that they can be adapted to any requirement of their user. Such requirement may arise from the preferred type of step or the type of equipment already possessed by the user.

It is also known that even if the boots of a known type for the skater's step have their attachments positioned farther backward, such attachments cannot be positioned farther backward than a given extent owing to intrinsic and structural reasons and for reasons linked to the anchorage mechanism included on the ski.

For the above reasons and for others which will emerge hereinafter the present applicant has designed, tested and embodied the present invention.

According to the surveys performed by the applicant the point of oscillation of the foot during the usage of a long-distance skiing boot can be located, according to the invention, as desired in a forward or rearward position.

According to the invention an elongate recess of a suitable section is provided, in the lower portion corresponding to the sole, in cooperation with the toe of a long-distance skiing boot, hereinafter called "boot". This recess accommodates an elongate element which can be anchored to the sole by one or two pins and which bears in its front end portion the attachments for connection to the anchorage comprised on the ski.

Resilient means of a replaceable type to govern the intensity of reaction movement are included between the upper front end portion of the above element and the front end portion of the boot.

The sole of the boot can be conformed as required, and the same applies to the anchorage comprised in the elongate element and able to be of any desired type.

The invention is therefore embodied with a toe for long-distance skiing boots of which the sole is conformed as required, the toe being characterized in that a recess to accommodate an elongate replaceable element is comprised in the front lower portion of the boot.

The attached figures, which are given as a non-restrictive example, show the following:

FIG. 1 shows a toe of a boot of a known type with the point of oscillation more rearwardly positioned, as is the case at the present time.

Figure 5:
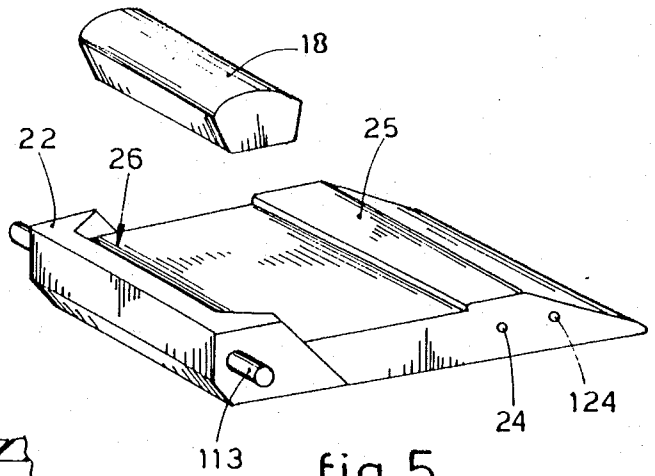
FIG. 5 shows a three-dimensional view of the elongate element of the embodiment of FIG. 2.
Figure 2:
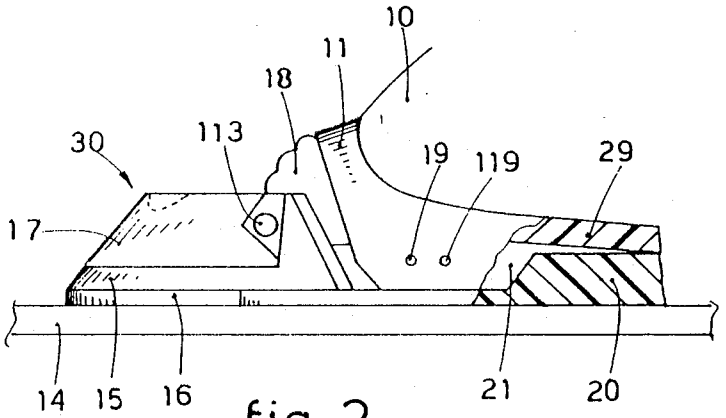
FIG. 2 shows a possible type of anchorage for a boot according to the invention.

A boot 10 comprises a toe 11 with a protrusion 12 which bears an attachment means 13, which in this example is comprised between two protrusions 12 located at the two sides of the toe 11.

This type of attachment not only requires a specific anchorage 30 on the ski but also permits an oscillation of the foot which is still positioned well forward for the skater's step; moreover, the attachment means is of a stationary type and serves for that specific type of ski anchorage alone and can provide those specific services alone.

FIGS. 2 to 6 show a possible embodiment of the present invention. A ski sole 16 may be included on a ski 14 if it is desired to provide ridges 20 which cooperate with recesses 21 comprised in a sole 29 of the boot 10.

An anchorage 30 is included on the ski and may be of any required type. The figures show as an example an anchorage 30 suitable to cooperate with attachments 113 positioned on the boot at the sides of an elongate element 22.

Figure 1:
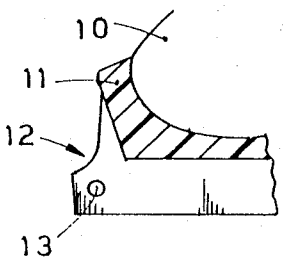
FIG. 1 shows a known type of boot with the more rearwardly positioned attachment known to the applicant.
Figure 4:
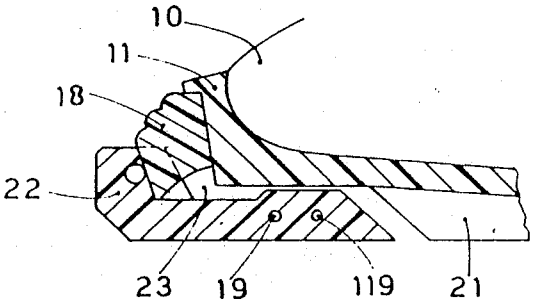
FIG. 4 shows the boot of FIG. 2 cutaway along a lengthwise section.
Figure 6:
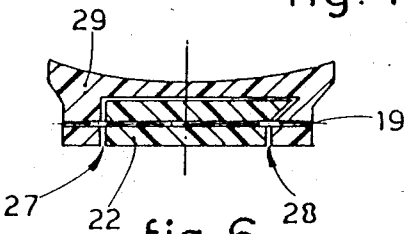
FIG. 6 shows a cross section of the boot of FIG. 2 with two variants.
Figure 3:
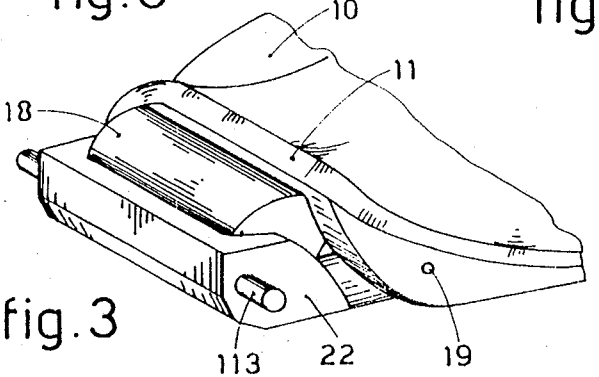
FIG. 3 shows a three-dimensional view of the boot of FIG. 2.

Such attachments may be of any type shown in FIG. 1 or may comprise a frontal plate or be of any other required type and be capable of adapting themselves to the specific anchorage 30 located on the ski or to the purposes of the skier.

In the example shown and employed also in the other figures the anchorage 30 consists of a sationary element 15 and a resiliently resisted movable element 17.

The boot 10 comprises in a frontal position a recess 23 which accommodates the elongate element 22.

The elongate element 22 includes one or more holes 24–124 suitable to cooperate with a pin 19 or 119 in a rearward position. This pin 19 or 119 may cooperate with the hole 24 or hole 124 respectively, thus being able to displace the oscillation of the foot to 19 or 119.

The position of the pins 19–119 is considerably farther to the rear in relation to the toe and lies almost below the toes of the skier.

It is possible to secure the elongate element 22 to the boot 10 by applying the two pins 19–119.

A resilient element 18 positioned between a seating 26 in the elongate element 22 and the toe 11 of the boot provides the boot with a resilient return movement. This resilient element 18 is advantageously pre-loaded when fitted and is of a replaceable type. The hardness of the resilient element 18 conditions the return thrust.

If it is desired to displace the oscillation from 19 or 119 to 113 without applying the two pins, a very hard resilient element 18 which can be only slightly compressed may be used.

A support ridge 25 comprised in the elongate element 22 assists movement.

The recess 23 (FIG. 6) may have a substantially rectangular section 27 (as shown on the lefthand side of FIG. 6), this section also facilitating oscillation about the pin 19 or 119. Otherwise the recess 23 may have an at least partially trapeziform section (as shown on the righthand side of FIG. 6) which is used with an elongate element 22 having a rectangular section if oscillation is to take place on 19 or 119, or may have a substantially trapeziform section, as shown in the figure, if oscillation is to take place on 113.

The idea of the solution comprises also the elongate element 22 formed crosswise with a C-shape and therefore incorporating part of the sole instead of being embodied as shown in the figures.

The idea of the solution covers also vertical bridges which connect the elongate element 22 in an oscillating manner to the sole by cooperating with the holes 19–24 and 119–124, thus providing equivalents.

I claim:

1. A long distance ski boot, comprising:

a toe member;

an elongate element having a front portion located anteriorly of said toe member and an extension portion extending beneath at least a portion of said toe member;

a seating surface formed in a posterior region of said front portion; and a removable and replaceable resilient element fitted within said seating surface and thus positioned between said toe member and said elongate element.

2. A boot as claimed in claim 1, wherein said toe and said elongate element being provided with aligned apertures and a pin extending through the apertures to secure the elongate element and the boot rotationally, the aperture in the boot being located in a position substantially below the toes of a skier wearing the boot.

3. A boot as claimed in claim 2, wherein a plurality of apertures are provided in the toe and the elongate element, at at least two locations along the length of the toe and the elongate element.

4. A boot as claimed in claim 1, wherein the resiliency of the resilient element is selected on the basis of the skiing motion utilized by a skier wearing the boot.

5. A boot as claimed in claim 2, wherein the elongate member is secured to the toe by means of at least one projection on the elongate element which cooperates with a second recess extending from the recess in the toe.

6. A boot as claimed in claim 2, wherein the front portion comprising means for securing the support element to an anchorage on a ski.

* * * * *